United States Patent [19]

Newton et al.

[11] 4,147,103

[45] Apr. 3, 1979

[54] FLAT SCREEN LIFT AND INTERRUPT MEANS

[75] Inventors: Eric W. Newton; Geoffrey Scott, both of Bradford, England

[73] Assignee: Champion Associated Weavers Limited, Bradford, England

[21] Appl. No.: 747,748

[22] Filed: Dec. 6, 1976

[30] Foreign Application Priority Data

Dec. 10, 1975 [GB] United Kingdom ..... 50683/75

[51] Int. Cl.[2] ..... B41F 15/10; B41F 15/36

[52] U.S. Cl. ..... 101/115; 101/123; 101/128.1

[58] Field of Search ..... 101/115, 127.1, 128.1, 101/123, 181, 182, 198, 199, 124

[56] References Cited

U.S. PATENT DOCUMENTS

| | | | |
|---|---|---|---|
| 1,731,896 | 10/1929 | Harris | 101/198 |
| 1,840,073 | 1/1932 | Williams | 101/123 |
| 2,104,894 | 1/1938 | Brophy | 101/198 |
| 2,500,230 | 3/1950 | Bailey et al. | 101/181 UX |
| 3,834,309 | 9/1974 | Zimmer | 101/115 |
| 3,926,111 | 12/1975 | Bohm | 101/127.1 X |
| 3,951,668 | 4/1976 | Schumacher et al. | 101/211 X |

FOREIGN PATENT DOCUMENTS

| | | | |
|---|---|---|---|
| 1210085 | 10/1970 | United Kingdom | 101/115 |

*Primary Examiner*—Ronald E. Suter

*Attorney, Agent, or Firm*—Pollock, Vande Sande & Priddy

[57] ABSTRACT

A method of printing a carpet with 'flat bed' carpet printing apparatus is described incorporating a plurality of screens or other printing heads comprising moving the carpet in a number of steps beneath the screens or heads and preventing at least one of the screens or heads from printing at least once during each printing sequence or pattern repeat.

8 Claims, 7 Drawing Figures

FLAT SCREEN LIFT AND INTERRUPT MEANS

This invention relates to carpet printing and to carpet printing apparatus.

BACKGROUND OF THE INVENTION

One type of carpet printing apparatus which is known generally as a 'flat bed' type comprises a number of screens or equivalent printing heads which are formed with the pattern to be printed and which are reciprocated simultaneously up and down to screen print a multcoloured pattern, each screen being provided with only one colour, onto a carpet which is moved in steps, beneath the screen. Such apparatus has only hitherto been capable of printing a regular over-all pattern having a small repeat distance on a carpet, the size of repeat being limited to the length of each screen. The apparatus has not been capable of printing a pattern having a large repeat distance, such as a "Persian" design, or of printing large squares or rectangles. This is due to the fact that if one of the screens is provided with a portion of the design to be printed say an end of a border, which is in fact only required to be printed once for each pattern repeat, then the border end would be printed each time the carpet is moved one step beneath the screens instead of appearing only at the end of the pattern.

BRIEF SUMMARY OF THE INVENTION

This problem is solved by a method in accordance with this invention of printing a carpet with 'flat bed' printing apparatus incorporating a plurality of screens or other printing heads wherein at least one of the screens or heads is not brought into contact with the carpet to effect a print at least once during each printing sequence, the screens or printing heads being brought into contact with the carpet to effect a print only when the part of the carpet to be printed with the particular portion of the design to be printed by that screen or head is located adjacent that screen or head. This enables large repeat patterns to be printed on the carpet.

In order to print a large repeat pattern regularly, each screen will be operated to effect a print the same number of times in every pattern repeat. For example, if the pattern repeat is substantially the combined length of four screens, each screen may be operated once, twice, three times or four times for every four steps of the carpet. If, however, every screen were to be operated at every step, the repeat distance would obviously be only the length of one step. Therefore, to obtain a pattern having a repeat distance of four steps, at least one of the screens must be operated less than four times for every four steps.

It will be appreciated that if, for example, a square pattern is to be printed say 4 yds.×4 yds. so that the carpet may be cut and sold in such squares, some screens may be printing a design on one square whereas other screens may be printing their portion of the design on preceding or succeeding squares in the direction of movement of the carpet length through the machine.

Flat bed carpet printing apparatus in accordance with this invention includes means to hold one or more of the screens or other printing heads in a non-operative position whilst allowing other pre-selected screens or heads to print their portion of the design on a carpet being moved step by step beneath the heads. This may conveniently be achieved by for example a solenoid device for each screen which can be actuated to allow a printing movement of the screens or heads only in accordance with a pre-selected programme.

Each screen may be selectively held in a non-operative position whenever desired, to allow a great number of pattern variations.

BRIEF DESCRIPTION OF THE DRAWINGS

The invention will now be further described by way of example with reference to the accompanying drawings, in which.

DESCRIPTION OF THE PREFERRED EMBODIMENT

Figure 1:
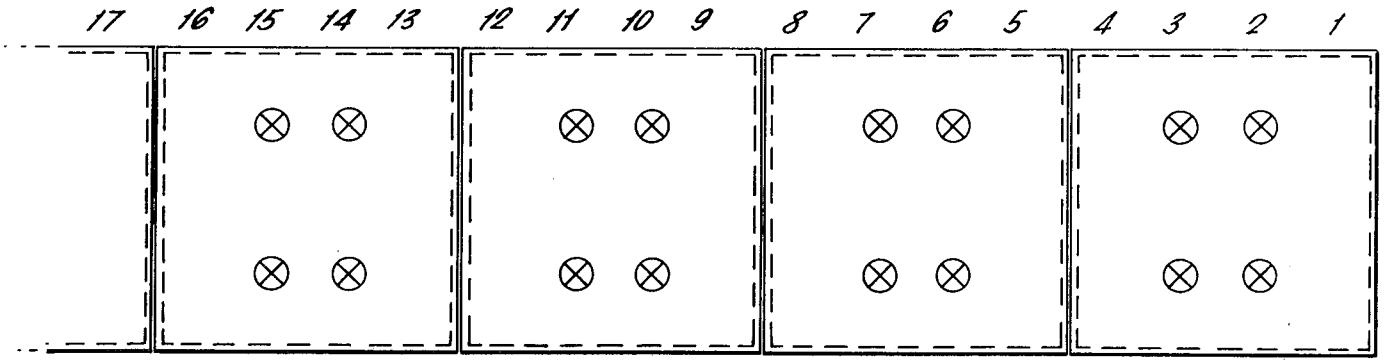
FIG. 1 is a diagram of a pattern in the form of a decorated bordered square to be printed on a carpet.

Referring to FIG. 1 there is shown a diagram of a pattern for printing carpet squares with a 2 colour combination border and centre motifs having two different colours. In this case, the centre motifs are crosses surrounded by differently coloured circles.

Figure 2:
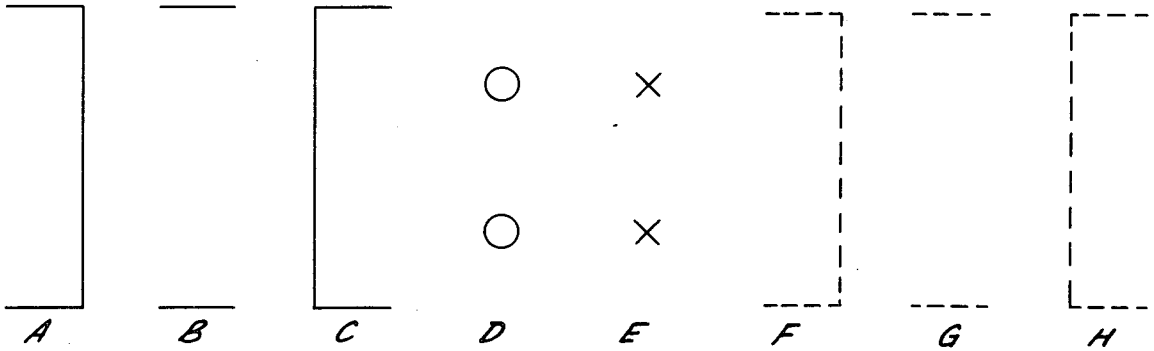
FIG. 2 is a diagram illustrating the pattern to be printed by each of the screens of a flat bed printing apparatus in accordance with the invention, to create the print pattern shown in FIG. 1.

To print such a design the screens of a flat bed carpet printing machine may carry the parts of the pattern illustrated at A–H in FIG. 2.

Assuming the carpet is fed beneath the screens to obtain the pattern shown in FIG. 1, the following sequence of printing should occur:

| Steps or Integers | Screens | | | | | | | |
|---|---|---|---|---|---|---|---|---|
| | A | B | C | D | E | F | G | H |
| 1 | P | | | | | | | |
| 2 | | | | | | | | |
| 3 | | | | | | | | |
| 4 | | P | | | | | | |
| 5 | P | P | | | | | | |
| 6 | | | | | | | | |
| 7 | | | | | | | | |
| 8 | | P | P | P | | | | |
| 9 | P | P | | P | | | | |
| 10 | | | | | P | | | |
| 11 | | | | | P | P | | |
| 12 | | P | P | P | | | | |
| 13 | P | P | | P | | | | |
| 14 | | | | | P | | P | |
| 15 | | | | | P | P | P | |
| 16 | | P | P | P | | | | |
| 17 | P | P | | P | | | | |
| 18 | | | | | P | | P | P |
| 19 | | | | | P | P | P | |
| 20 | | P | P | P | | | | |
| 21 | P | P | | P | | | | |
| 22 | | | | | P | | P | P |

P=Position in which a screen is operated to effect a print. 1 . . . 22=Number of steps moved by carpet beneath screens (see FIG. 1).

After the carpet has been moved eighteen times, the first carpet square has been printed with its complete design and the second and third and fourth squares are partly printed. The sequence of printing shown in steps 19–22 then continues until the whole carpet length has been printed. It will be appreciated that one screen can only print in one colour and it is preferred that lighter colours are printed before darker.

It will be observed that, for the repeated sequence (i.e. steps 19–22 above) each screen prints the same number of times, and at corresponding steps, in each repeat of four steps. This produces a regularly repeated pattern. However, the frequency of printing of one or more screens within each repeat may be altered to obtain a different pattern.

Figure 3:
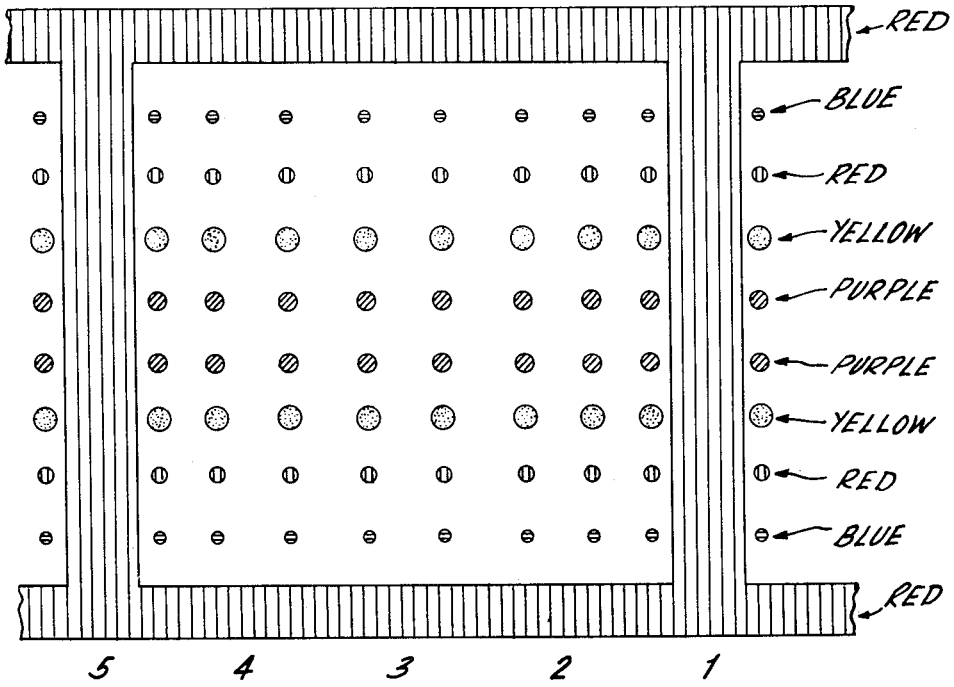
FIG. 3 is a diagram of a further and multicoloured pattern
Figure 4:
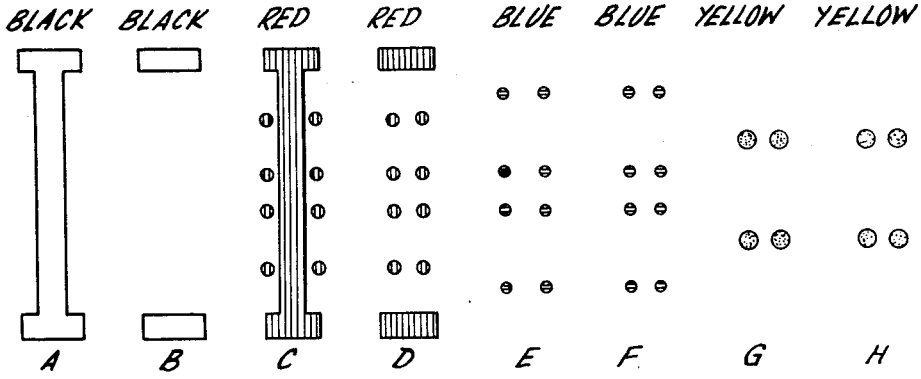
FIG. 4 is a diagram similar to FIG. 2 but corresponding to the pattern of FIG. 3.

In the multi-colour example illustrated in FIG. 3 (the colours being indicated by the wording at the right hand side of the drawing), the colour pattern is brought close to the left and right hand borders of the square and the border is filled with a colour. One arrangement of eight screens to print this design is shown in FIG. 4 (the colours printed by the various screens being indicated above the diagrammatic representations of the screens) and it will be noticed that in order to get the pattern up to the border, i.e. in an irregular position within the square with respect to the rest of the pattern, two screens have to be used to print each other as well as two screens to print the outline of the border. It will also be noted that two colours (red and blue in the example illustrated) are printed coincidentally to produce a fourth colour (i.e. purple) on part of the design.

Assuming the square shown in FIG. 3 is in the middle of a carpet length and assuming the carpet is passing from left to right beneath the screens, the screens will print in the following sequence.

| Steps or Integers | Screens A | B | C | D | E | F | G | H |
|---|---|---|---|---|---|---|---|---|
| 1 | P | | | | | | | |
| 2 | | | | | | | | |
| 3 | | | | | | | | |
| 4 | | P | | | | | | |
| 5 | P | P | P | | | | | |
| 6 | | P | | | | | | |
| 7 | | | | | | | | |
| 8 | | P | | P | | | | |
| 9 | P | P | P | P | P | | | |
| 10 | | P | | P | | | | |
| 11 | | | | | | | | |
| 12 | | P | | P | | P | | |
| 13 | P | P | P | P | P | P | P | |
| 14 | | P | | P | | P | | |
| 15 | | | | | | | | |
| 16 | | P | | P | | P | | P |
| 17 | P | P | P | P | P | P | P | P |
| 18 | | P | | P | | P | | P |
| 19 | | | | | | | | |
| 20 | | P | | P | | P | | P |
| 21 | P | P | P | P | P | P | P | P |
| 22 | | P | | P | | P | | P |

The printing sequence shown in steps 19-22 is the repeated.

The operation of the system will be better understood by considering in detail some of the steps in the printing sequence. For example:

In step 1 Screen A prints the right hand border of the pattern.

In step 5 Screen A prints the left hand border, Screen B prints part of the upper and lower border, and Screen C fills in the right hand border and prints the red design adjacent to that border. In step 13 Screen A prints the left hand border of the third square (right hand border of the fourth square), Screen B prints part of the upper and lower borders of the third square, Screen C fills in the right hand border of the third square and prints the red design adjacent that border, Screen D prints the central red design in the second square and fills in part of the top and bottom borders, Screen E prints the blue design adjacent the right hand border of the second carpet square, Screen F prints the central part of the blue design (in position three) of the first square, and Screen G prints the yellow design adjacent the right hand border of the first carpet square.

It will of course be appreciated that whilst the screens are being used to print the design of FIG. 3 on the square illustrated, some of the screens are also being used to print part of the design in the preceding and succeeding squares.

It will be realised that it is not necessary to print a regularly repeated pattern, some screens may be held inoperative for some printing steps in one repeat and not for those steps in other repeats. Many complicated designs such as, for example, "Persian" designs may be printed using the basic principle explained above.

In practice there will probably be a gap between screens, so that the screen may overlap somewhat into adjacent areas to obtain a flowing pattern.

Figure 5:
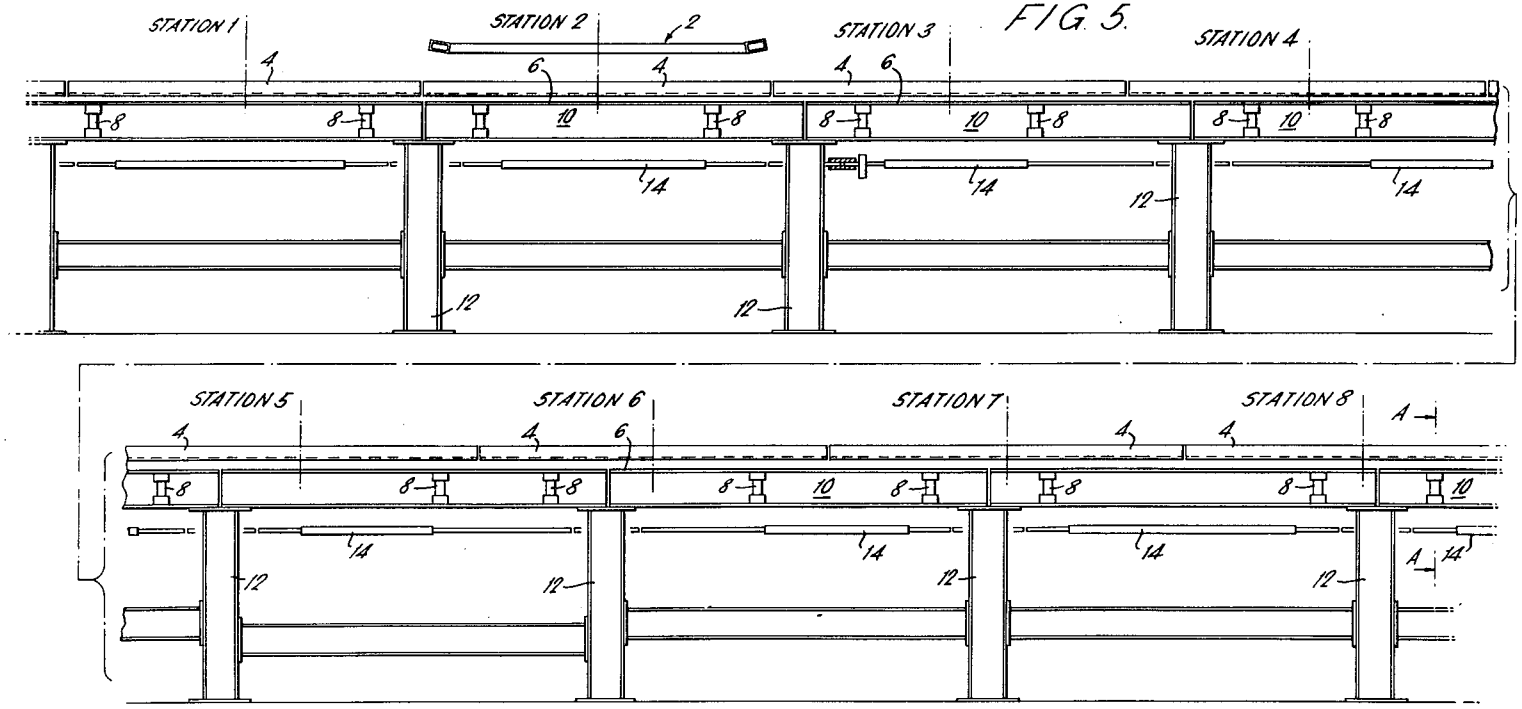
FIG. 5 is a side elevation taken along the length of a flat bed carpet printing apparatus in accordance with this invention to illustrate the arrangement of the screens.
Figure 6:
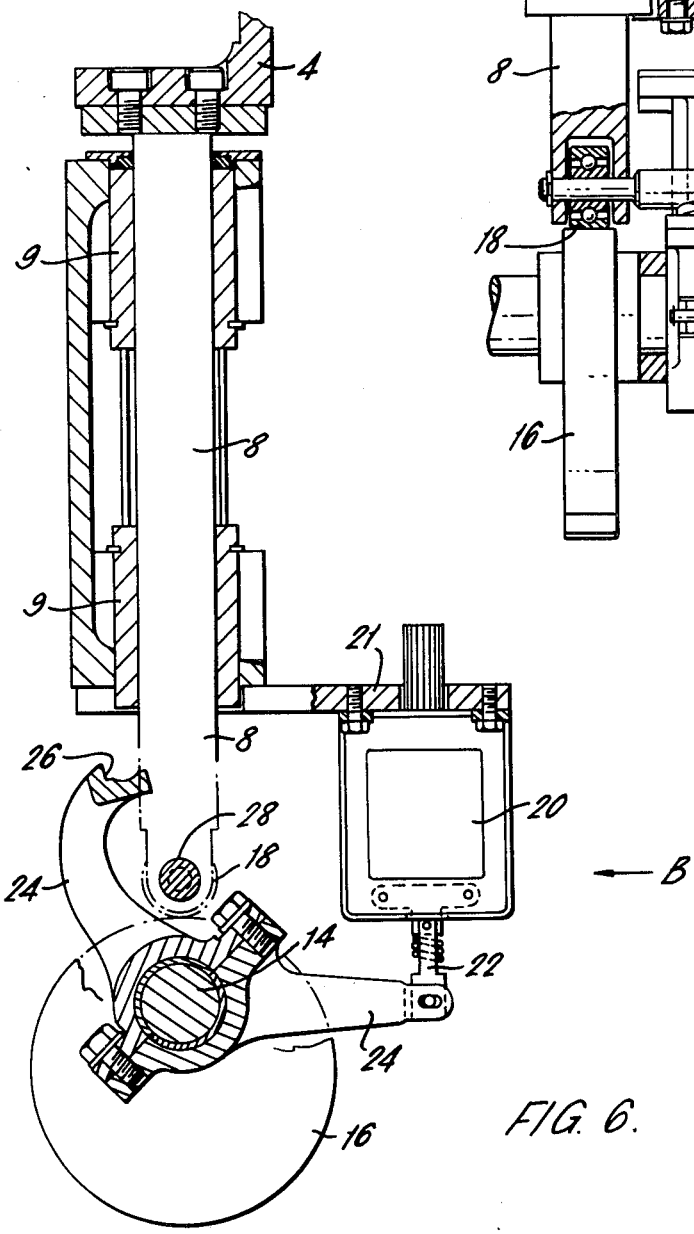
FIG. 6 is a section in the direction of the arrow A in FIG. 5 illustrating a means for preventing selected screens for being operative on all printing strokes.
Figure 7:
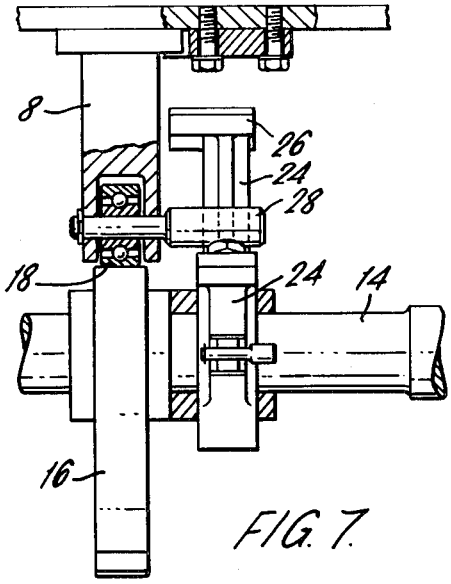
FIG. 7 is a view in the direction of the arrow B in FIG. 6 with one part omitted for clarity.

FIGS. 5 to 7 show part of one embodiment of printing apparatus adapted to perform the method of this invention. Referring to FIG. 5, eight flat screens 2, (only one of which is shown in the drawing and separated from its support frame 4) are spaced along the length of the machine at stations 1–8 as shown. Each frame 4 which is of angle section is lifted up from the flat bed 6 of the apparatus by means of push rods 8, four for each screen.

The flat bed over which a length of carpet is drawn in steps is supported by a framework including longitudinal members 10 and legs 12, A cam shaft 14 extends beneath the members 10 at each side of the apparatus and is rotated by means (not shown).

As can be seen in FIG. 6, each cam 16 carried by the cam shaft engages a roller 18 secured to the bottom end of a push rod 8 mounted in bearings 9, so that during rotation of the shaft 14 the rods 8 and hence the screens are lifted periodically, to allow the carpet to index forwardly, and then drop onto the carpet to carrying out a printing operation; downward pressure on the carpet being aided by magnetic means (not shown).

Printing apparatus as basically described above, is already in use and to modify this apparatus to carry out the method of the invention a solenoid 20 is provided for each cam and push rod 8, the solenoids being carried by a flange 21 of the machine frame. The operating shaft 22 of the solenoid is pivotally connected to one arm of a bell crank lever 24 pivoted about the cam shaft, the other arm of the bell crank being provided in its outer end with a push rod rest member 26.

In use, if it is desired that any particular screen be held inoperative so as not to print at any one printing operation then the solenoids of the push rods of that screen are activated, when the push rods and screens are in the raised non-printing position, to pivot the bell crank 24 from the position shown in FIG. 6 in a clockwise direction until the rest 26 lies beneath a pin 28 extending out transversely from the bottom of the push rod 8. On further rotation of the cam 16 the push rod 8 drops until the pin 28 engages the bell crank rest 26 which prevents further downward movement of the push rod and screen and thus prevents the screen from effecting the next printing step.

When the push rod is again lifted by the cam, the solenoid may be de-activated and return under the influence of a spring to a position in which (as can be seen in FIG. 6) the push rod and screen can descend to carry out a printing operation.

It will be appreciated that the various solenoids can be controlled in accordance with a predetermined programme to produce the desired pattern.

It will also be appreciated that the retention of the screens in the non-printing position could be achieved in other ways, for example by using a different set of cams for each screen. The advantage of the device shown in FIGS. 6 and 7 is that it can very readily be fitted to an existing machine and the solenoid units can then be programmed differently to produce different patterns.

What is claimed is:

1. A printing machine comprising a frame; a printing bed supported on the frame; a printing screen supported on said frame and moveable between printing and non-printing positions; a push-rod mounted in position to push said screen from printing position to non-printing position; rotatable cam means mounted adjacent said push-rod for contacting said push-rod and moving said push-rod and screen from printing to non-printing position on rotation of said cam means; cam shaft means connected with said cam means for rotating same; push-rod rest means mounted on said cam shaft means for pivotal movement about said shaft into and out of push-rod engaging position, in which position said rest means prevents movement of the push-rod and screen into printing position; and means for causing said rest means to move into and out of its push-rod engaging position.

2. Apparatus according to claim 1 wherein said frame is an elongated frame on which is supported a plurality of flat printing screens reciprocable between printing position and raised, non-printing position.

3. Apparatus according to claim 2 wherein a plurality of push-rods are positioned to push each of said screens upwardly, said cam shaft means extending longitudinally of said frame, and said cam means being positioned to lift and lower said rods and screens between non-printing and printing position.

4. Apparatus according to claim 1 wherein said push rod rest means includes lever arm means which, in push-rod engaging position, prevents movement of the push-rod and screen into printing position, and said means for causing includes solenoid means connected to said lever arm means for applying thereto the force required to move said rest means.

5. Apparatus according to claim 4 wherein said lever arm means is a bell crank having its two arms extending from said cam shaft means, one of said arms having said rest member thereon and the other of said arms being connected with a solenoid, which constitutes said means for causing said rest means to move into and out of push-rod engaging position.

6. Apparatus according to claim 5 wherein said solenoid is connected to a single rest means.

7. Apparatus according to claim 1 wherein said push-rod includes a pin extension through which said push-rod is engaged by said rest means.

8. A printing machine comprising an elongated frame; a printing bed supported on the frame; a plurality of flat printing screens supported on said frame and reciprocable between printing position and a raised non-printing position; a plurality of push-rods mounted in position to push each of said screens upwardly from printing position to non-printing position; rotatable cam means mounted adjacent said push-rods for lifting and lowering said push-rods and screens between non-printing and printing position on rotation of said cam means; cam shaft means extending longitudinally of said frame and connected with said cam means for rotating same; push-rod rest means including lever arm means mounted on said cam shaft means for pivotal movement about said shaft into and out of push-rod engaging position, in which position said rest means prevents downward movement of the raised push-rod and screen into printing position; and solenoid means connected directly to said lever arm means for applying thereto the force required to move said rest means into and out of push-rod engaging position.

* * * * *